US010703129B2

(12) United States Patent
Dai et al.

(10) Patent No.: US 10,703,129 B2
(45) Date of Patent: Jul. 7, 2020

(54) ELECTRIC PENCIL SHARPENER

(71) Applicant: NINGBO WEISHU STATIONERY CO., LTD, Ningbo, Zhejiang (CN)

(72) Inventors: Changhai Dai, Zhejiang (CN); Zhongmin Duan, Zhejiang (CN)

(73) Assignee: NINGBO WEISHU STATIONERY CO., LTD, Ningbo, Zhejiang (CN)

( * ) Notice: Subject to any disclaimer, the term of this patent is extended or adjusted under 35 U.S.C. 154(b) by 306 days.

(21) Appl. No.: 15/680,520

(22) Filed: Aug. 18, 2017

(65) Prior Publication Data

US 2018/0319203 A1 Nov. 8, 2018

(30) Foreign Application Priority Data

May 5, 2017 (CN) ..... 2017 1 0312006

(51) Int. Cl.
*B43L 23/02* (2006.01)
*B43L 23/00* (2006.01)

(52) U.S. Cl.
CPC ..... *B43L 23/02* (2013.01); *B43L 23/002* (2013.01); *B43L 23/006* (2013.01); *B43L 23/008* (2013.01)

(58) Field of Classification Search
CPC ..... B43L 23/00; B43L 23/002; B43L 23/004; B43L 23/006; B43L 23/008; B43L 23/02; B43L 23/04; B43L 23/06; B43L 23/08; B43L 23/085
See application file for complete search history.

(56) References Cited

U.S. PATENT DOCUMENTS

2008/0060720 A1* 3/2008 Hu ..... B43L 23/002 144/28.5
2008/0163955 A1* 7/2008 Mak ..... B43L 23/00 144/28.5
2009/0000695 A1* 1/2009 Hu ..... B43L 23/002 144/28.72

(Continued)

FOREIGN PATENT DOCUMENTS

CN 1935533 A 3/2007
CN 101314302 A 12/2008
CN 105291667 A 2/2016

OTHER PUBLICATIONS

First Office Action dated May 17, 2018 for Chinese Appl.No. 201710312006.6, 7 pages.

*Primary Examiner* — Teresa M Ekiert
*Assistant Examiner* — Jared O Brown
(74) *Attorney, Agent, or Firm* — Yue (Robert) Xu; Apex Attorneys at Law, LLP

(57) ABSTRACT

An electric pencil sharpener includes a power device. The power device is connected to two rotatable rubber wheels by a transmission mechanism. The two rubber wheels are located on two sides of the pencil to be sharpened, are rotated in opposite directions and closely fit a side wall of the pencil to be sharpened, to push upwards or downwards the pencil to be sharpened to move. A gap between the two rubber wheels is adjustable. The electric pencil sharpener further includes a rotatable cutter carrier assembly located below the rubber wheels configured to sharpen the pencil to be sharpened. The electric pencil sharpener can sharpen the pencil of different diameters, and has a sharpening process requiring no human participation, has a wide application and saves manual operation.

8 Claims, 8 Drawing Sheets

(56) References Cited

U.S. PATENT DOCUMENTS

| | | | | |
|---|---|---|---|---|
| 2010/0326568 | A1* | 12/2010 | Schumacher | B43L 23/00 144/28.5 |
| 2011/0226383 | A1* | 9/2011 | Hu | B43L 23/002 144/28.6 |
| 2013/0255835 | A1* | 10/2013 | Wang | B43L 23/002 144/28.2 |
| 2015/0000791 | A1* | 1/2015 | Zhong | B43L 23/02 144/407 |

* cited by examiner

ELECTRIC PENCIL SHARPENER

CROSS REFERENCE OF RELATED APPLICATION

The present application claims the priority to Chinese Patent Application No. 201710312006.6, titled "ELECTRIC PENCIL SHARPENER", filed on May 5, 2017 with the State Intellectual Property Office of the People's Republic of China, the content of which application is incorporated herein by reference in its entirety.

FIELD

This application relates to the technical field of sharpeners, and particularly to an electric pencil sharpener.

BACKGROUND

A pencil sharpener, also referred to as a sharpener, generally includes a main body, a pencil clamping mechanism, a pencil sharpening mechanism and a scrap box. A groove accommodating a pencil cutter is generally provided at the bottom of the scrap box, and the pencil cutter is inserted in the groove to be positioned. The user can choose a main pencil cutter of the sharpener to sharpen a pencil, or take out the scrap box and use the pencil cutter in the scrap box to sharpen the pencil. If the main pencil cutter of the sharpener is a planar cutter, after becoming blunt, the main pencil cutter of the sharpener can be replaced with the pencil cutter taken out of the scrap box, thus forming a sharpener with a sharp sharpening edge.

However, the sharpener can only sharpen the pencils with a constant outer diameter.

Therefore, a technical issue to be addressed presently by those skilled in the art is to provide an electric pencil sharpener which can address the issue that only pencils with a constant outer diameter can be sharpened.

SUMMARY

It is an object of the present application to provide an electric pencil sharpener which can address the issue that only pencils with a constant outer diameter can be sharpened.

In order to achieve the above object, an electric pencil sharpener is provided according to the present application, which includes a power device. The power device is connected to two rotatable rubber wheels via a transmission mechanism, the two rubber wheels are located on two sides of a pencil to be sharpened, are rotated in opposite directions and closely fit a side wall of the pencil to be sharpened, to push upwards or downwards the pencil to be sharpened to move, a gap between the two rubber wheels is adjustable, the electric pencil sharpener further includes a rotatable cutter carrier assembly which is located below the rubber wheels and configured to sharpen the pencil to be sharpened.

Preferably, the transmission mechanism includes:

a cutter carrier gear connected to the power device and located below the rubber wheels, a rotation axis of the cutter carrier gear is perpendicular to a rotation axis of each of the rubber wheels;

an end face gear engaged with the cutter carrier gear, a rotation axis of the end face gear is in parallel with the rotation axis of each of the rubber wheels;

a transition gear located at an outer side of the end face gear and engaged with the end face gear, a rotation axis of the transition gear is in parallel with the rotation axis of the end face gear and is located below the rotation axis of the end face gear; and a pencil introducing gear located at an upper side of the transition gear and engaged with the transition gear, a pencil introducing gear shaft of the pencil introducing gear is moved coaxially with a rubber wheel shaft sleeve of the rubber wheel, and the pencil introducing gear shafts are both arranged onto a pencil introducing mechanism holder having a fixed relative position, two sides of the pencil introducing mechanism holder have respectively arc-shaped retaining grooves configured to restrict movement loci of the pencil introducing gear shafts; the arcs of the two arc-shaped retaining grooves are coincident with the movement loci of the pencil introducing gears with respect to the transition gear respectively, to adjust the gap between the two rubber wheels.

Preferably, the pencil introducing mechanism holder is provided with racks drivingly connected to the two pencil introducing gear shafts respectively, the two racks are each engaged with a return gear hinged to the pencil introducing mechanism holder, and the two racks are located at an upper side and a lower side of the return gear respectively, to allow the two rubber wheels to synchronously clamp or release the pencil to be sharpened.

Preferably, both of the racks are each also connected to a rack restoring spring, to allow the gap between the two rubber wheels to be restored to an initial state when the pencil to be sharpened is withdrawn from the gap between the two rubber wheels, and also to provide a clamping force of the two rubber wheels with respect to the pencil.

Preferably, the cutter carrier assembly has a preset angle with respect to the pencil to be sharpened, and the cutter carrier assembly is connected to the power device to achieve rotary sharpening of the cutter carrier assembly.

Preferably, the electric pencil sharpener further includes an internal gear configured to support the cutter carrier assembly and drive the cutter carrier assembly to rotate, and the internal gear is located at an outer side of the cutter carrier assembly and is connected to the power device.

Preferably, the electric pencil sharpener includes a MCU, a first switch, a second switch, a first driving circuit, and a second driving circuit, the first switch is arranged below the pencil to be sharpened, and a tip touch block is provided between the first switch and a tip of the pencil to be sharpened, when the pencil to be sharpened is transferred to the cutter carrier assembly by the rubber wheels and is sharpened by the cutter carrier assembly, the tip touches the tip touch block, and the first switch is turned on by a transmission rod;

the second switch is located at an entrance position of the pencil to be sharpened, and when the pencil to be sharpened is inserted between the two rubber wheels, a pencil introducing switch pressing block located at a movement locus of the pencil to be sharpened is pressed to an outer side of the pencil to be sharpened to turn on the second switch;

the first switch and the second switch are respectively connected to two input pins of the MCU;

a first terminal of the first driving circuit and a first terminal of the second driving circuit are respectively connected to two output pins of the MCU, and a second terminal of the first driving circuit is connected to a first end of the power device, a second terminal of the second driving circuit is connected to a second end of the power device, the second terminal of the first driving circuit is connected to the second terminal of the second driving circuit;

a first ground electrode and a first voltage electrode are also connected between the first terminal of the first driving circuit and the second terminal of the first driving circuit, and a second ground electrode and a second voltage electrode are also connected between the first terminal of the second driving circuit and the second terminal of the second driving circuit; and when the first switch and the second switch are both turned off, the power device does not work; when the first switch is turned off and the second switch is turned on, the power device rotates toward a direction of transferring the pencil to be sharpened to the cutter carrier assembly; and when the first switch and the second switch are both turned on, the power device rotates toward a direction of moving the pencil to be sharpened away from the cutter carrier assembly.

Preferably, the first driving circuit includes a first NPN-type triode, a first PMOS transistor and a first NMOS transistor;

a base of the first NPN-type triode is connected to the MCU, an emitter of the first NPN-type triode is connected to the first ground electrode, and a collector of the first NPN-type triode is connected to the first voltage electrode;

a gate electrode of the first PMOS transistor and a gate electrode of the first NMOS transistor are each connected between the collector of the first NPN-type triode and the first voltage electrode;

a source electrode of the first PMOS transistor and a drain electrode of the first NMOS transistor are each connected to the first end of the power device;

the second driving circuit includes a second NPN-type triode, a second PMOS transistor, and a second NMOS transistor;

a base of the second NPN-type triode is connected to the MCU, an emitter of the second NPN-type triode is connected to the second ground electrode, and a collector of the second NPN-type triode is connected to the second voltage electrode;

a gate electrode of the second PMOS transistor and a gate electrode of the second NMOS transistor are each connected between the collector of the second NPN-type triode and the second voltage electrode;

a source electrode of the second PMOS transistor and a drain electrode of the second NMOS transistor are each connected to the second end of the power device; and the source electrode of the first PMOS transistor is connected to the source electrode of the second PMOS transistor and is grounded; the source electrode of the first PMOS transistor is connected to the source electrode of the second PMOS transistor; the drain electrode of the first PMOS transistor is connected to the drain electrode of the second PMOS transistor and is connected to the first ground electrode.

Preferably, the first switch and the second switch are connected in parallel, and then are connected to a grounding output pin of the MCU and are then grounded.

Preferably, the MCU, the first driving circuit and the second driving circuit are integrated on a printed circuit board, and the printed circuit board is located below the first switch.

Compared with the above background technology, the electrical sharpener according to the present application realizes the rotation of the two rubber wheels by using the power device; the two rubber wheels are located respectively on two sides of the pencil to be sharpened, and the rotation directions of the two rubber wheels are opposite; the pencil to be sharpened between the two rubber wheels can be moved upwards or downwards with the rotation of the two rubber wheels; the cutter carrier assembly is provided below the rubber wheels to sharpen the pencil to be sharpened. The specific working process is as follows: in an initial state, a gap between the two rubber wheels is small, and when the pencil to be sharpened is inserted between the two rubber wheels, the gap between the two rubber wheels is gradually increased; and the two rubber wheels rotate in the opposite directions and are rotating toward an inner side, that is, toward the side of the pencil to be sharpened, to enable the pencil to be sharpened to move downwards, when the pencil to be sharpened is in the working area of the cutter carrier assembly, the sharpening work may just be performed; after the sharpening finishes, the two rubber wheels respectively rotate toward an outer side of the pencil to achieve the upward moving of the pencil, to further bring the pencil away from the working area of the cutter carrier assembly. When the pencil exits from the gap between the two rubber wheels, the gap between the two rubber wheels is restored to an original state. Arranged as such, the electric pencil sharpener can sharpen the pencils of different diameters, and has a sharpening process requiring no human participation, has a wide application, and saves manual operation.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for those skilled in the art, other drawings may be obtained based on the provided drawings without any creative effort.

DETAILED DESCRIPTION

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, obtained by those skilled in the art without any creative efforts, fall into the scope of the present application.

For making those skilled in the art to better understand the technical solutions of the present application, the present application is further described in detail hereinafter with reference to the drawings and specific embodiments thereof.

An electric pencil sharpener according to the present application includes a sharpener body. A power device 4 is provided inside the sharpener body, and the power device 4 may be a power element such as a motor. The power device 4 is connected to two rubber wheels 25 by a transmission mechanism. The rubber wheels 25 are rotatable relative to the sharpener body, and the two rubber wheels 25 rotate in opposite directions.

There is a certain preset gap between the two rubber wheels 25. When the pencil to be sharpened is inserted between the two rubber wheels 25, a side wall of the pencil to be sharpened can push the two rubber wheels 25 to move outwards to increase the gap between the two rubber wheels 25. That is, the two rubber wheels 25 are hinged to the sharpener body and hinge shafts of the rubber wheels 25 are slidable relative to the sharpener body to adjust the gap between the two rubber wheels 25.

The rotational directions of the two rubber wheels 25 are opposite under the action of the transmission mechanism. When the pencil to be sharpened is inserted into the gap between the two rubber wheels 25, and the pencil to be sharpened closely fits the two rubber wheels 25, the pencil to be sharpened can be moved upwards or downwards under the act of the rotation of the two rubber wheels 25. Taking FIG. 5 of the specification as an example, the rubber wheel 25 on a left side of the pencil 9 moves in a clockwise direction, the rubber wheel 25 on a right side of the pencil 9 moves in a counterclockwise direction, and the pencil 9 closely fits the two rubber wheels 25, thus the pencil 9 is moved downwards. And if the rubber wheel 25 on the left side of the pencil 9 moves in the counterclockwise direction, and the rubber wheel 25 on the right side of the pencil 9 moves in the clockwise direction, the pencil 9 is moved upwards.

Figure 1:
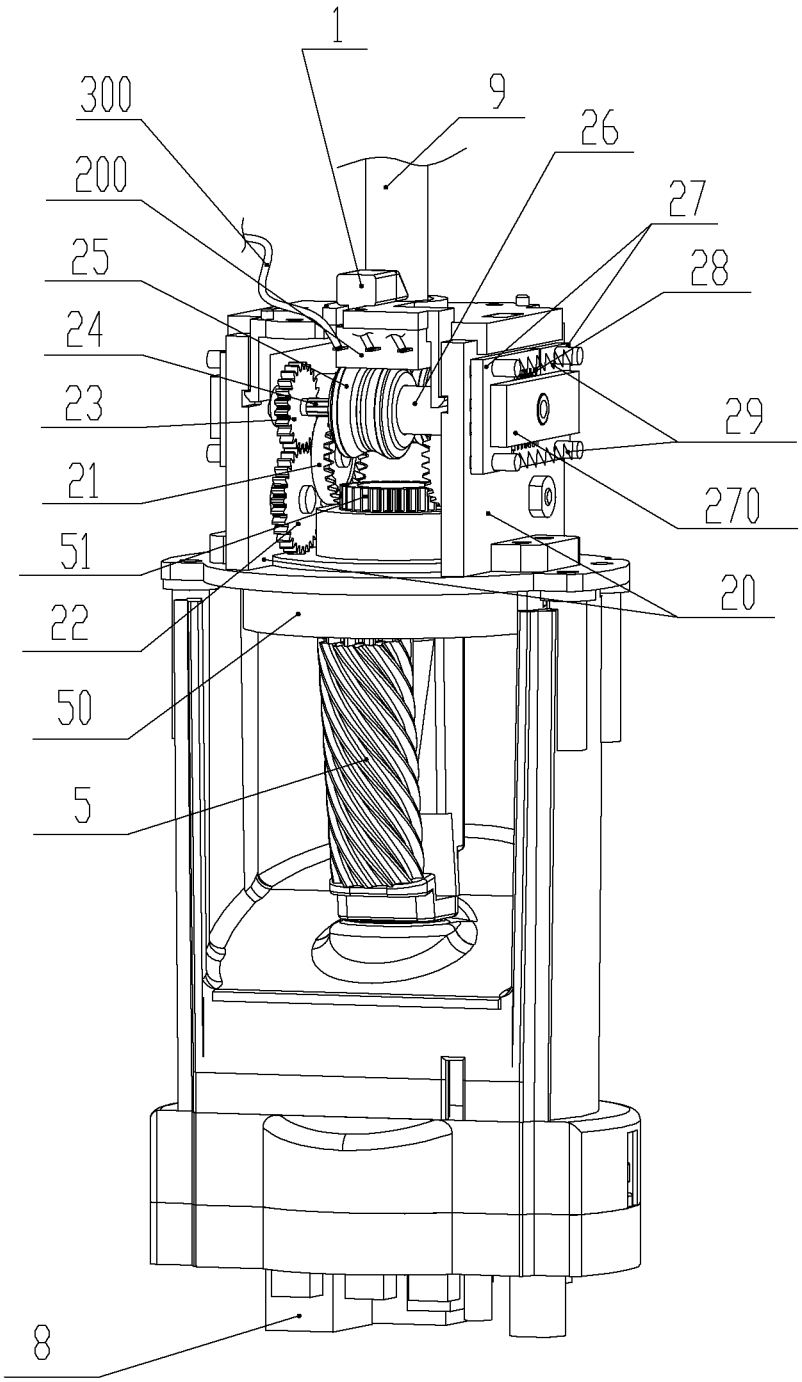
FIG. 1 is a schematic view showing the structure of an electric pencil sharpener according to an embodiment of the present application.

A cutter carrier assembly 5 located inside the sharpener body is arranged below the rubber wheels 25, as shown in FIG. 1 of the specification. When the pencil 9 is moved downwards to a working area of the cutter carrier assembly 5, the pencil 9 is sharpened. After sharpening of the pencil 9 finishes, the pencil 9 is driven by the two rubber wheels 25 to move upwards and is brought away from the working area of the cutter carrier assembly 5. The cutter carrier assembly 5 should rotate during sharpening so as to sharpen the pencil 9. The cutter carrier assembly 5 may be rotated by the power source of the power device 4.

In view of the above embodiment in which the two rubber wheels 25 are rotated in the opposite directions by the power device 4 and the two rubber wheels 25 slide outwards with respect to the sharpener body, the following embodiments are provided according to the present application. Of course, for those skilled in the art, other different arrangements should fall into the scope of the present application.

Figure 5:
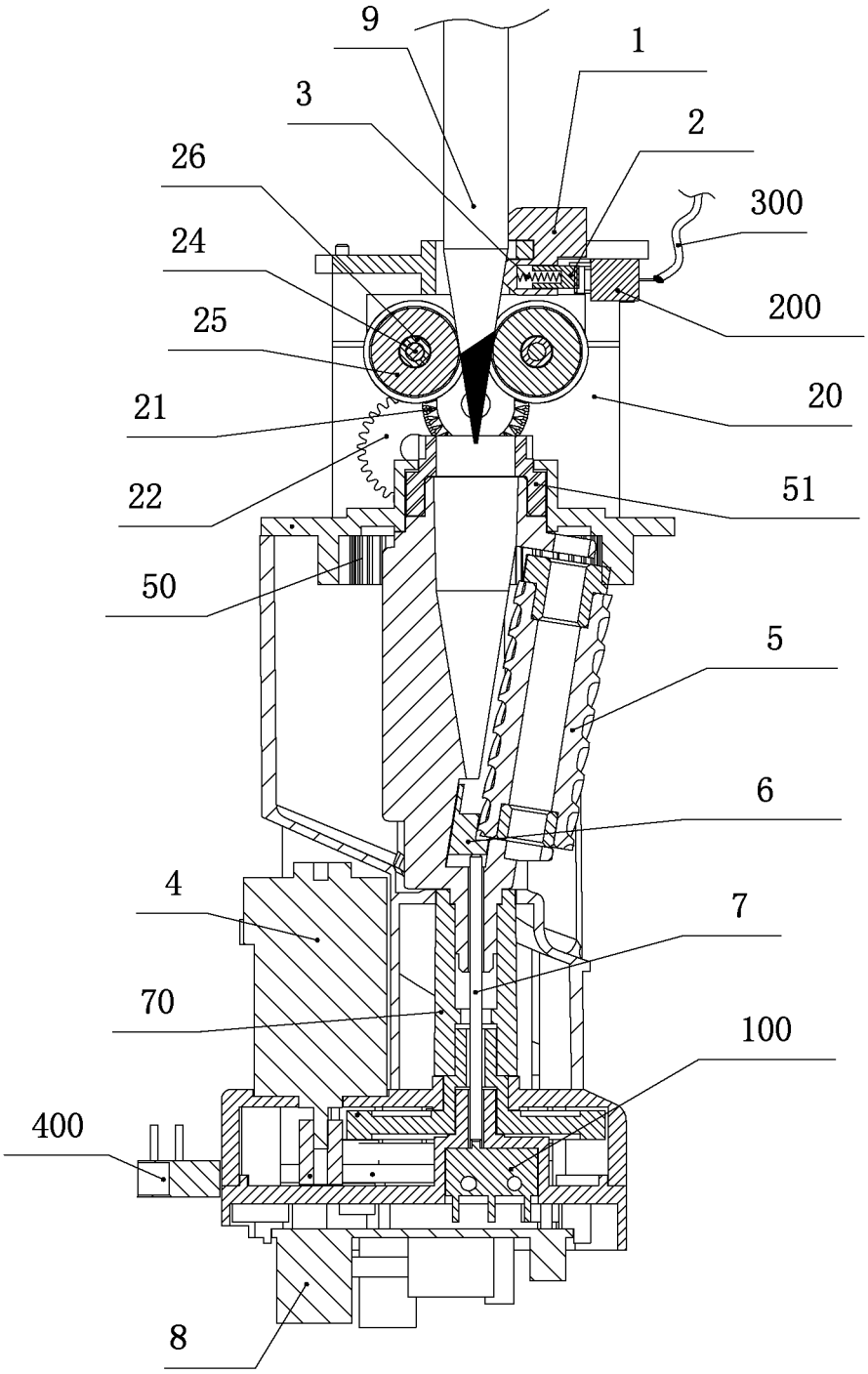
FIG. 5 is a schematic view of the electric pencil sharpener according to the embodiment of the present application in a state of just starting to operate.
Figure 6:
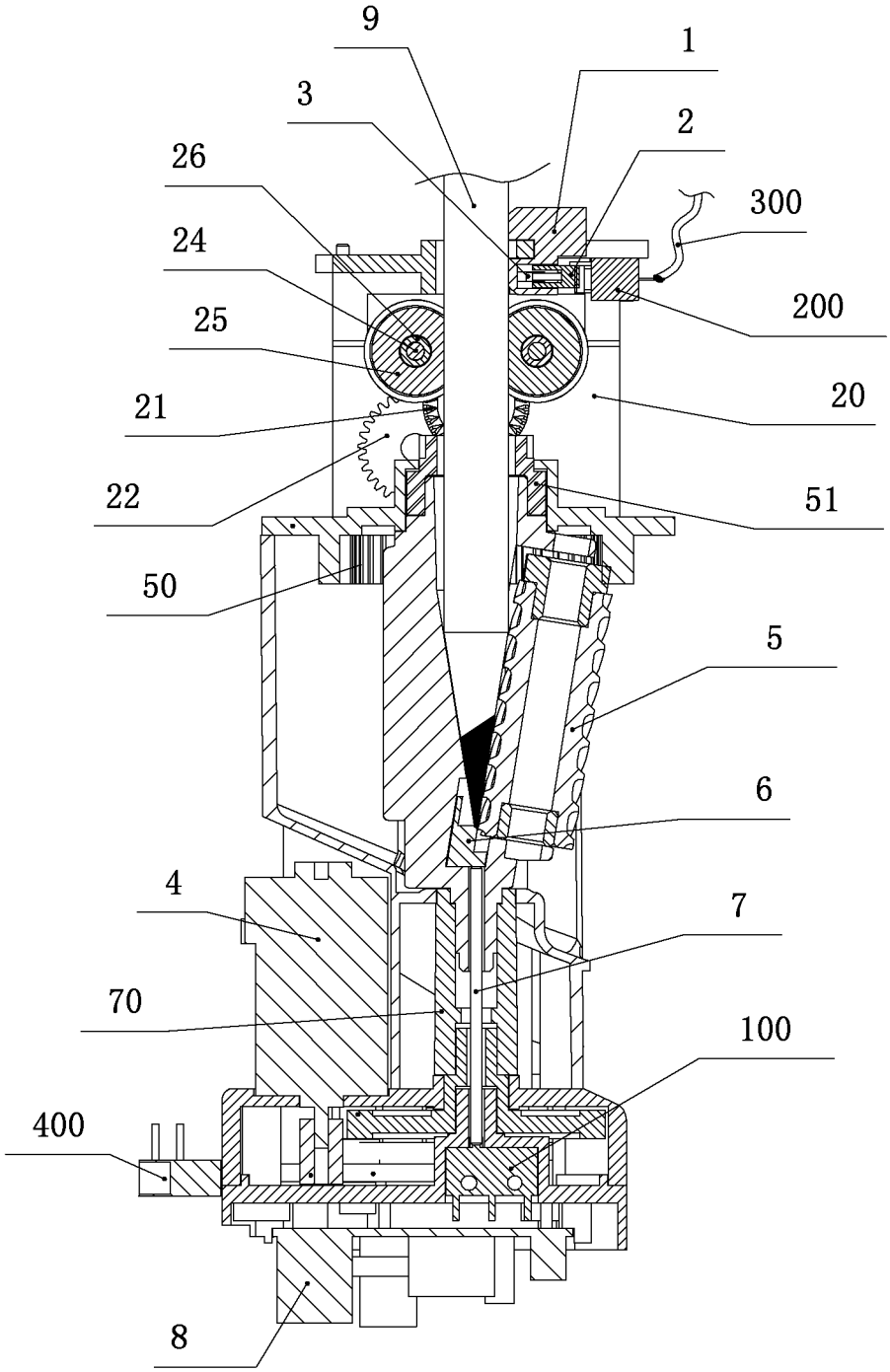
FIG. 6 is a schematic view of the electric pencil sharpener according to the embodiment of the present application when a pencil is sharpened.

The transmission mechanism mainly includes a cutter carrier gear 51, an end face gear 21, a transition gear 22, a pencil introducing gear 23, a pencil introducing gear shaft 24 and a rubber wheel shaft sleeve 26, as shown in FIGS. 1, 5 and 6.

The cutter carrier gear 51 is located below the rubber wheels 25, and the rotation axis of the cutter carrier gear 51 is perpendicular to the rotation axis of the rubber wheel 25, that is, the rotation axis of the rubber wheel 25 is horizontal and the rotation axis of the cutter carrier gear 51 is perpendicular to the ground. The cutter carrier gear 51 is connected to the power device 4, an output shaft of the power device 4 is arranged to be perpendicular to the ground, and the power device 4 is located on a side below the cutter carrier assembly 5, thus the cutter carrier gear 51 is revolved about the rotation axis perpendicular to the ground.

The end face gear 21 is engaged with the cutter carrier gear 51 to achieve a transmission connection, the rotation axis of the end face gear 21 is perpendicular to the rotation axis of the cutter carrier gear 51, to convert a rotation in a direction perpendicular to the ground into a horizontal rotation, that is, the rotation axis of the end face gear 21 is in parallel with the rotation axis of the rubber wheel 25. The transition gear 22 is located on an outer side of the end face gear 21, and the end face gear 21 has teeth on its outer side, which are not shown in the drawings. The rotating shaft of the transition gear 22 is driven by the teeth of the end face gear 21 to rotate, and the rotation axis of the transition gear 22 is in parallel with the rotation axis of the end face gear 21, and the rotation axis of the transition gear 22 is located below the rotation axis of the end face gear 21.

The pencil introducing gear 23 is arranged at an upper side of the end face gear 21 and is drivingly connected to the transition gear 22 and engaged with the transition gear 22. The pencil introducing gear shaft 24 of the pencil introducing gear 23 is coaxially moved with the rubber wheel shaft sleeve 26 of the rubber wheel 25. That is, the pencil introducing gear shaft 24 and the rubber wheel shaft sleeve 26 are located in the same horizontal line and the pencil introducing gear shaft 24 is located at an inner side of the rubber wheel shaft sleeve 26, and the rubber wheel shaft sleeve 26 is sleeved on the pencil introducing gear shaft 24 to achieve synchronous rotation of the both. The pencil introducing gear 23 is synchronously rotated with the pencil introducing gear shaft 24, and the rubber wheel 25 is synchronously rotated with the rubber wheel shaft sleeve 26 to further ensure that the pencil introducing gear 23, the pencil introducing gear shaft 24, the rubber wheel 25, and the rubber wheel shaft sleeve 26 are rotated synchronously.

Each of the rubber wheels 25 is provided with one pencil introducing gear shaft 24 and one rubber wheel shaft sleeve 26, and each of the pencil introducing gear shafts 24 is provided with one pencil introducing gear 23. So there are two rubber wheels 25, two pencil introducing gears 23, two pencil introducing gear shafts 24 and two rubber wheel shaft sleeves 26 in the present application.

Figure 4:
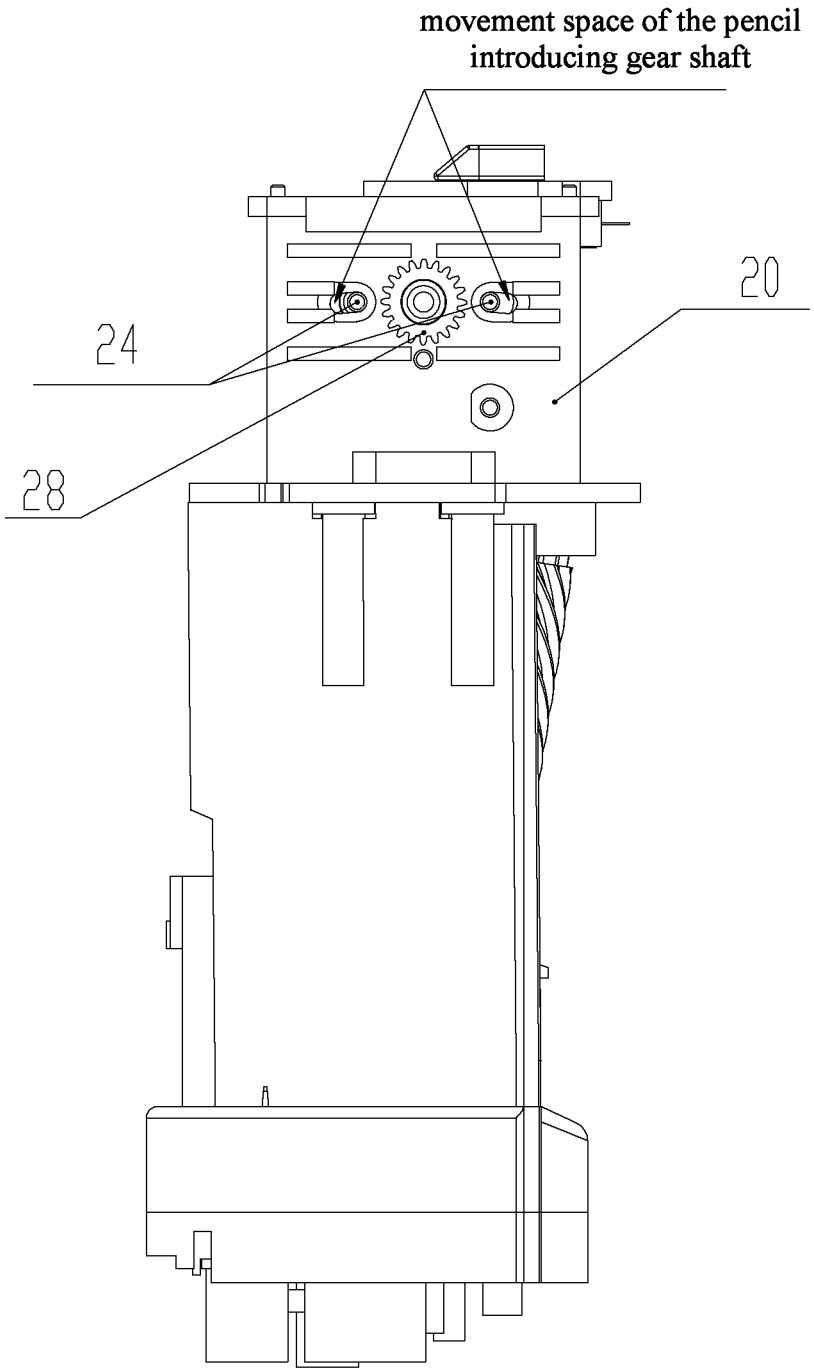
FIG. 4 is a schematic view of FIG. 2 with racks, the rack clamping plate and the rack restoring springs being hidden.

The sharpener body described above includes a pencil introducing mechanism holder 20 which is located on an upper position of the sharpener body, and the sharpener body and the pencil introducing mechanism holder 20 are relatively fixed in position. The pencil introducing gear shaft 24 is arranged on the pencil introducing mechanism holder 20 and is rotatable relative to the pencil introducing mechanism holder 20. The pencil introducing mechanism holder 20 has arc-shaped retaining grooves on both sides, the pencil introducing gear shaft 24 is slidably located in the arc-shaped retaining grooves to adjust the gap between the two pencil introducing gear shafts 24, i.e., the gap between the two pencil introducing gears 23 and between the two rubber wheels 25, as shown in FIG. 4.

Figure 7:
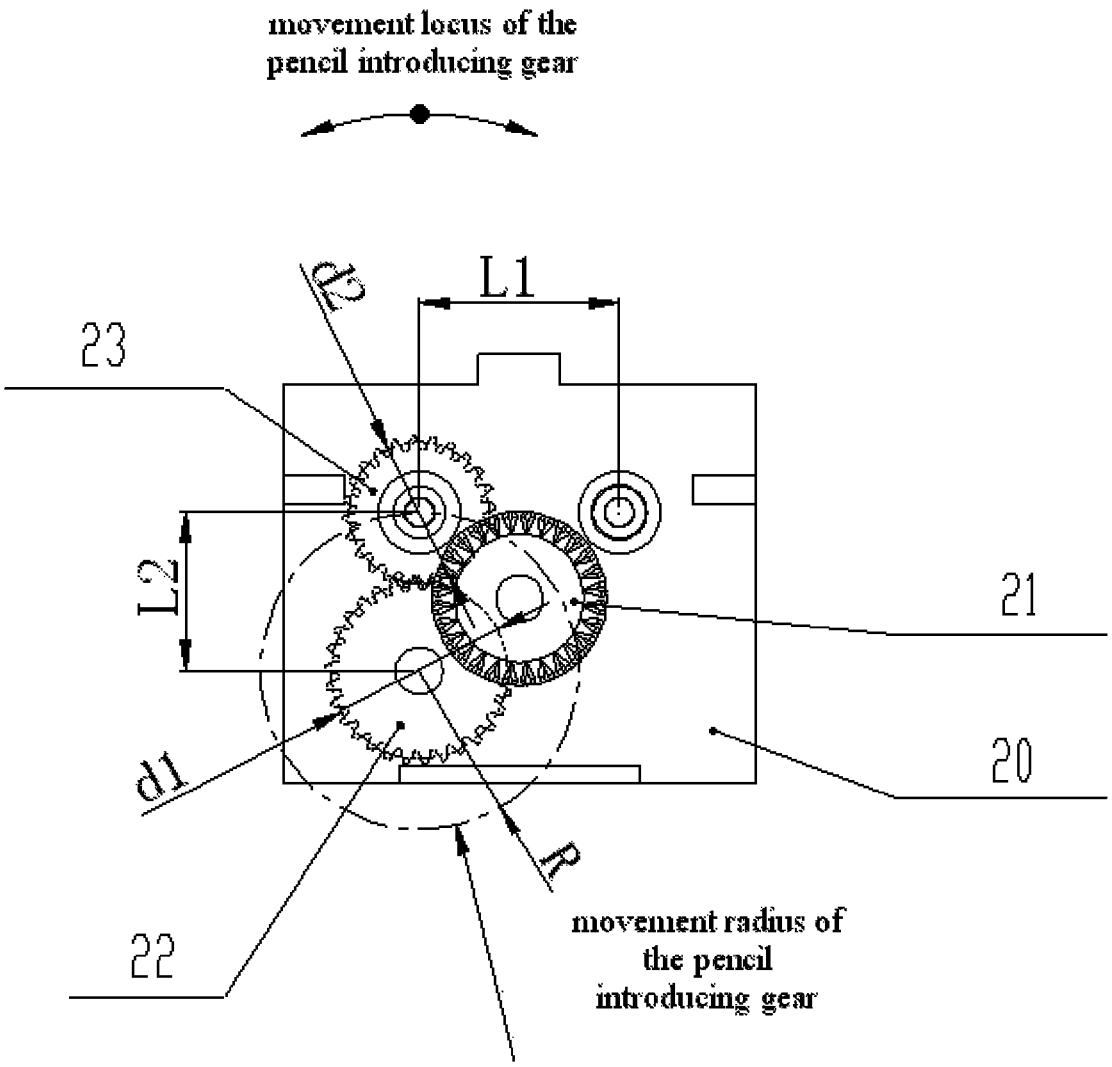
FIG. 7 is a diagram showing the movement principle of a pencil introducing gear in FIG. 1.

The arc of each of the two arc-shaped retaining grooves is coincident with a movement locus of the respective pencil introducing gear 23 with respect to the respective transition gear 22, to adjust the gap between the two rubber wheels 25. That is, the center position of the pencil introducing gear 23 is arranged on a circular arc with a radius equal to the result of dividing the sum of reference diameters of the transition gear 22 and the pencil introducing gear 23 by 2, as shown in FIG. 7. The pencil introducing mechanism holder 20 is provided with an arc-shaped retaining groove for movement of the pencil introducing gear shaft 24, as shown in FIG. 4. The spatial shape of the arc-shaped retaining groove is arranged along the movement locus of the pencil introducing gear 23, as shown in FIG. 7, to ensure that the pencil introducing gear 23 can be always normally engaged with the transition gear 22 while moving along the locus. The principle of the engagement of the pencil introducing gear 23 and the transition gear 22 is as shown in FIG. 7. When a pencil 9 with a different diameter is inserted, the pencil 9 may push the pencil introducing gear 23 to move in the direction of the movement locus, and the pencil introducing gear 23 then pushes the rubber wheel 25 to move in the same movement locus by the rubber wheel shaft sleeve 26 and the pencil introducing gear shaft 24 which is fixedly connect to the pencil introducing gear 23, so as to achieve the purpose of adjusting the distance between the two rubber wheels 25 (i.e., the diameter of the pencil 9).

In FIG. 7 of the specification, d1 is a reference circle diameter of the transition gear 22, and d2 is a reference circle diameter of the pencil introducing gear 23. The movement radius R of the pencil introducing gear 23 satisfies relationship: R=(d1+d2)/2. The distance L2 between the pencil introducing gear 23 and the transition gear 22 satisfies relationship: L2=R, and the distance between the two rubber wheels 25 (i.e., the diameter of the pencil 9) is L1.

In the present application, in order to ensure the symmetry of the movements of the two rubber wheels and thus ensure that the pencil can always move along the axis of the cutter carrier assembly without being eccentric during sharpening, the pencil introducing mechanism holder 20 is provided with a rack 27 and a return gear 28. Each of the pencil introducing gear shafts 24 is connected to one rack 27, and two racks 27 are located on an upper side and a lower side of the return gear 28 respectively, so that the two racks 27 are both engaged with the return gear 28, and the return gear 28 is hinged to the pencil introducing mechanism holder 20.

Figure 2:
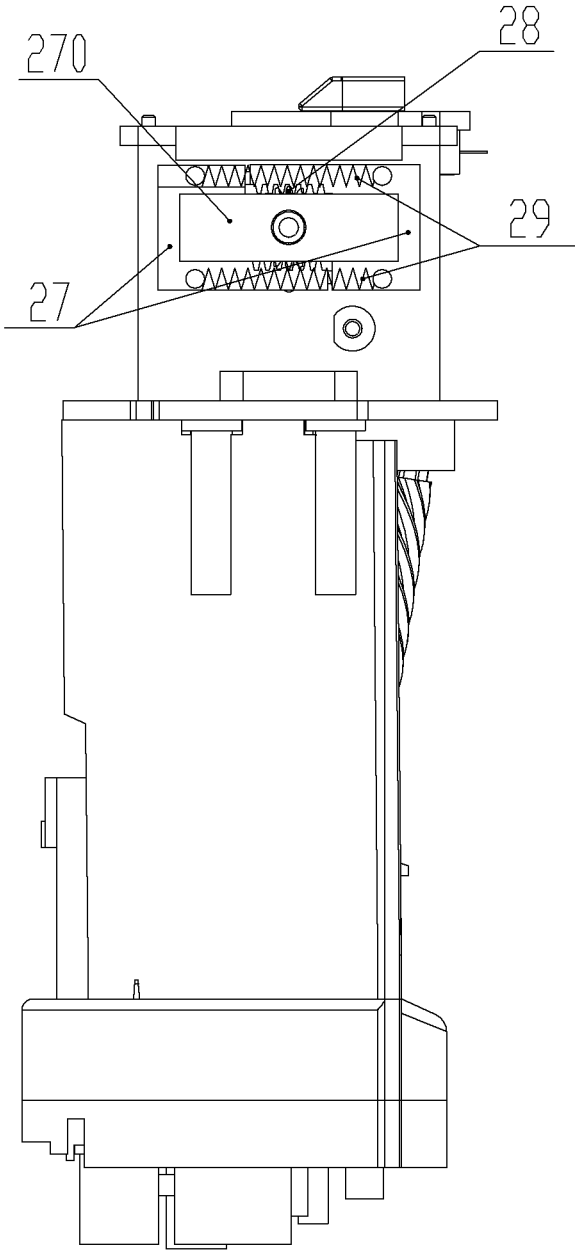
FIG. 2 is a side view of FIG. 1.
Figure 3:
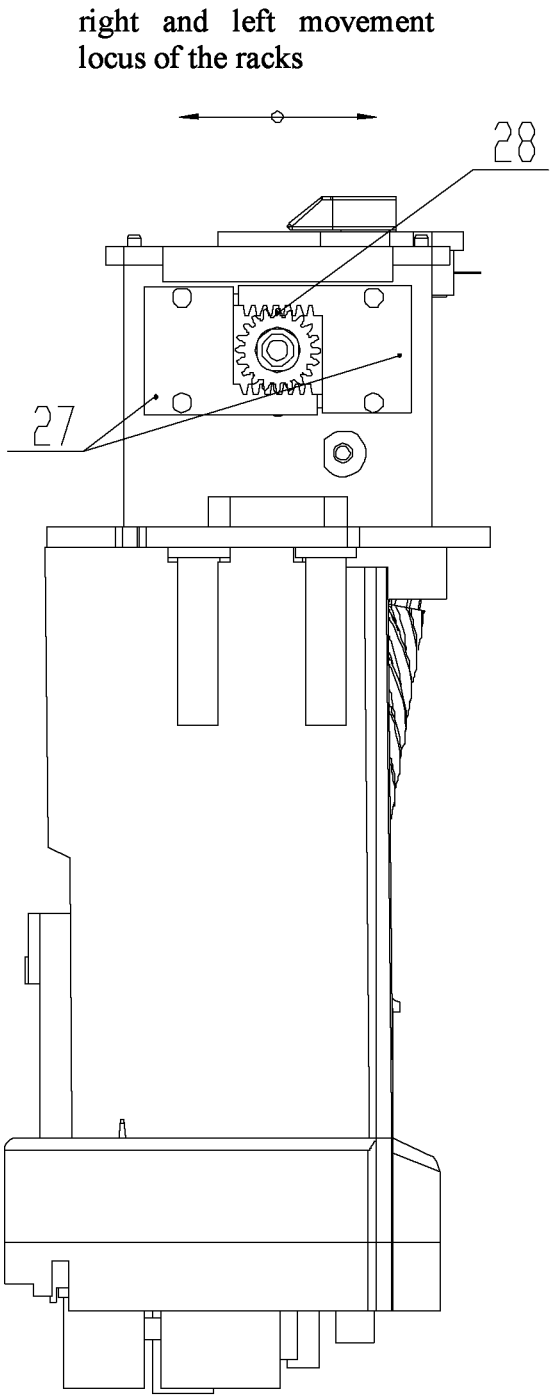
FIG. 3 is a schematic view of FIG. 2 with a rack clamping plate and rack restoring springs being hidden.

That is, a lateral side of the pencil introducing mechanism holder 20 is provided with one return gear 28 and two racks 27 which are symmetrically distributed with respect to the axis of the return gear 28, as shown in FIGS. 2 to 4. The rack 27 is connected to the pencil introducing gear shaft 24 to drive the rubber wheel 25 to move.

Its working principle is as follows: two racks 27 are arranged symmetrically with respect to the axis of the return gear 28 and are in engaged with the return gear 28; thus when one rack 27 moves, the other rack 27 may be moved in an opposite direction at the same time by the rotation of the return gear 28, thus may ensure that the two rubber wheels 25 are simultaneously in a state of clamping or releasing the pencil, and the opposite positions of the two rubber wheels 25 are always in symmetrical positions with respect to the rotation axis of the cutter carrier assembly 5, thereby ensuring that the pencil 9 always moves along the rotation axis of the cutter carrier assembly 5 and may not be eccentrically sharpened.

In addition, both of the racks 27 are also connected to rack restoring springs 29 respectively, as shown in FIG. 2 of the specification, thus allowing the gap between the two rubber wheels 25 to be restored to an initial state when the pencil is withdrawn from the gap between the two rubber wheels 25, and to provide a clamping force of the two rubber wheels with respect to the pencil. That is, a rack clamping plate 270 and rack restoring springs 29 are further designed on the surfaces of the racks 27 and the return gear 28. Two ends of the rack restoring spring 29 are connected to the two racks 27 respectively to ensure that the two racks 27 always move towards each other, and when pencils 9 of different diameters are placed between the rubber wheels 25, the two rubber wheels 25 may always apply a certain pressure and frictional force to the pencils 9. The rack clamping plate 270 can ensure the smoothness of movement of the two racks 27.

In the present application, the cutter carrier assembly 5 has a preset angle with respect to the pencil 9 to be sharpened, and the cutter carrier assembly 5 is connected to the power device 4 to realize a rotary sharpening of the cutter carrier assembly 5, as shown in FIGS. 5 and 6. An internal gear 50 is connected to the power device 4 so as to rotate about a vertical axis, and the internal gear 50 supports the cutter carrier assembly 5. While rotating, the internal gear 50 may drive the cutter carrier assembly 5 to revolve about the pencil 9 to complete the sharpening. The internal gear 50 is located at an outer side of the cutter carrier assembly 5 and is connected to the power device 4, as shown in FIGS. 1, 5 and 6 of the specification.

Figure 8:
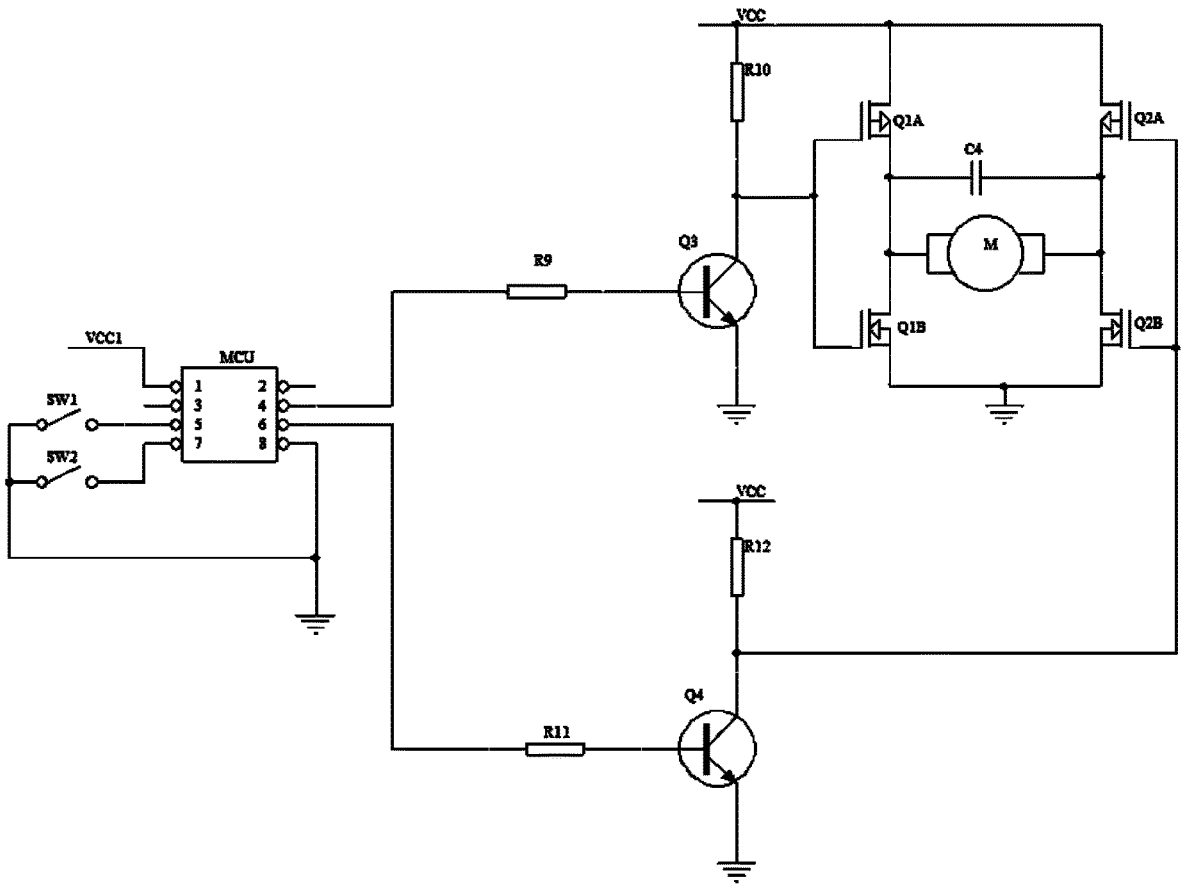
FIG. 8 is a schematic circuit diagram of the electric pencil sharpener according to the embodiment of the present application.

In the present application, in order to realize the rotation of the power device 4, an MCU, a first switch 100, a second switch 200, a first driving circuit and a second driving circuit are further provided, as shown in FIG. 8 of the specification.

The first switch 100 is arranged below the pencil 9 to be sharpened, and a tip touch block 6 is provided between the first switch 100 and the tip of the pencil 9 to be sharpened. When the pencil 9 to be sharpened is transferred to the cutter carrier assembly 5 by the rubber wheels 25 and is sharpened by the cutter carrier assembly 5, the tip touches the tip touch block 6, to drive the tip touch block 6 to move to turn on the first switch 100 by a transmission rod 7.

The second switch 200 is located at an entrance position of the pencil 9 to be sharpened, and when the pencil 9 to be sharpened is inserted between the two rubber wheels 25, a pencil introducing switch pressing block 2 on the movement locus of the pencil 9 to be sharpened is pressed to an outer side of the pencil to be sharpened, to turn on the second switch 200.

The first switch 100 and the second switch 200 are respectively connected to two input pins of the MCU.

A first terminal of the first driving circuit and a first terminal of the second driving circuit are respectively connected to two output pins of the MCU; and a second terminal of the first driving circuit is connected to a first end of the power device 4, a second terminal of the second driving circuit is connected to a second end of the power device 4, and the second terminal of the first driving circuit is connected to the second terminal of the second driving circuit.

A first ground electrode and a first voltage electrode are also connected between the first terminal of the first driving circuit and the second terminal of the first driving circuit, and a second ground electrode and a second voltage electrode are also connected between the first terminal of the second driving circuit and the second terminal of the second driving circuit.

When the first switch and the second switch are both turned off, the power device 4 does not work. When the first switch is turned off and the second switch is turned on, the power device 4 rotates toward the direction of transferring the pencil to be sharpened to the cutter carrier assembly 5; and when the first switch is turned on and the second switch is turned on, the power device 4 rotates toward the direction of moving the pencil to be sharpened away from the cutter carrier assembly 5.

Specifically, the power device 4 is just the component M in FIG. 8 of the specification. The power device 4 rotating toward the direction of transferring the pencil to be sharpened to the cutter carrier assembly 5 refers to that, taking the case in FIG. 5 as an example, the rubber wheel 25 on the left side of the pencil 9 is moved in the clockwise direction and the rubber wheel 25 on the right side of the pencil 9 is moved in the counterclockwise direction, to achieve the downward moving of the pencil 9. The power device 4 rotating toward the direction of moving the pencil to be sharpened away from the cutter carrier assembly 5 refers to that, taking the case in FIG. 5 as an example, the rubber wheel 25 on the left side of the pencil 9 moves in the counterclockwise direction and the rubber wheel 25 on the right side of the pencil 9 moves in the clockwise direction, thus the pencil 9 moves upwards.

More specifically in the present application, the first driving circuit comprises a first NPN-type triode Q3, a first PMOS transistor Q1A and a first NMOS transistor Q1B. The reference numerals of the respective electronic elements are the same as those of FIG. 8, which are not described hereinafter.

A base of the first NPN-type triode Q3 is connected to the MCU and a resistor R9 may be connected in series therebetween. An emitter of the first NPN-type triode Q3 is connected to the first ground electrode, and a collector of the first NPN-type triode Q3 is connected to the first voltage electrode VCC; the first voltage electrode VCC is at an upper right position in FIG. 8, and the resistor R10 may further be connected in series between the collector of the first NPN-type triode Q3 and the first voltage electrode VCC.

A gate electrode of the first PMOS transistor Q1A and a gate electrode of the first NMOS transistor Q1B are each connected between the collector of the first NPN-type triode Q3 and the first voltage electrode VCC.

A source electrode of the first PMOS transistor Q1A and a drain electrode of the first NMOS transistor Q1B are connected to the first end of the motor M.

The second driving circuit includes a second NPN-type triode Q4, a second PMOS transistor Q2A, and a second NMOS transistor Q2B.

A base of the second NPN-type triode Q4 is connected to the MCU, and a resistor R11 may be connected in series therebetween, an emitter of the second NPN-type triode Q4 is connected to the second ground electrode, a collector of the second NPN-type triode Q4 is connected to a second voltage electrode VCC, and a resistor R12 may be connected in series between the collector of the second NPN-type triode Q4 and the second voltage electrode VCC.

A gate electrode of the second PMOS transistor Q2A and a gate electrode of the second NMOS transistor Q2B are connected between the collector of the second NPN-type triode Q4 and the second voltage electrode VCC.

A source electrode of the second PMOS transistor Q2A and a drain electrode of the second NMOS transistor Q2B are connected to the second end of the motor M.

The source electrode of the first NMOS transistor Q1B is connected to the source electrode of the second NMOS transistor and is grounded; the source electrode of the first PMOS transistor Q1A is connected to the source electrode of the second PMOS transistor; the drain electrode of the first PMOS transistor Q1A is connected to the drain electrode of the second PMOS transistor and is connected to the first ground electrode.

The first switch 100 (i.e., SW1 in FIG. 8 of the specification) and the second switch 200 (i.e., SW2 in FIG. 8 of the specification) are connected in parallel, and are then connected to a grounding output pin (i.e., an eighth pin) of the MCU and are then grounded. The specific way of connection is shown in FIG. 8 of the specification.

The working principle of the electric pencil sharpener of the present application is as follows.

First, after an external power supply is connected into the circuit via a DC socket 400, normally, both the first switch 100 and the second switch 200 are turned off, both a fourth pin and a sixth pin of the MCU output a high level, and two ends of the motor M (i.e., the power device 4) are in a high level, the motor M does not rotate, the voltage between two ends of the power device 4 is zero, the power device 4 does not rotate, and the sharpener does not work.

When the pencil 9 is inserted between the two rubber wheels 25, the pencil 9 may push the pencil introducing switch touch block 1 to move toward a micro switch SW2 (i.e., the second switch 200) and then push the pencil introducing switch pressing block 2 by contacting the spring 3 to turn on the micro switch SW2. After this signal is detected by the MCU, the fourth pin of the MCU outputs a low level, the sixth pin of the MCU outputs a high level, the low level and the high level are then loaded to the motor M (i.e., the power device 4), thus the power device 4 starts to rotate in a forward direction.

The power device 4 rotates forwards to drive the driving mechanism, and the drive mechanism further drives the two rubber wheels 25 to rotate in the direction of transferring the pencil 9 to the cutter carrier assembly 5. When rotates, the rubber wheels 25 drive the pencil 9 to move downwards, and when the pencil 9 comes to contact with the cutter carrier assembly 5, the sharpening operation starts. When the pencil 9 continues to move downwards till a pencil lead is sharpened, the pencil lead may push the tip touch block 6 to move downwards, and the tip touch block 6 then pushes the transmission rod 7 to press the micro switch SW1 (i.e., the first switch 100), to turn on the micro switch SW1. After this signal is detected by the MCU, the fourth pin of the MCU outputs a high level, the sixth pin of the MCU outputs a low level, the high level and the low level are then loaded to the motor M (i.e., the power device 4) by the driving circuit, and the power device 4 starts to rotate reversely. A transmission tube 70 is provided on an outer side of the transmission rod 7 to restrict a movement position of the transmission rod 7. A cable 300 connected to the micro switch SW2 (i.e., the second switch 200) may be led out from the upper portion of the sharpener body.

The motor rotates reversely to drive, by the driving mechanism, the rubber wheels 25 to rotate in the direction of moving the pencil 9 away from the cutter carrier assembly 5, so that the pencil 9 is moved upwards, and the micro switch SW1 (i.e., the first switch 100) is turned off. After the pencil 9 is completely withdrawn, the SW2 (i.e., the second switch 200) is turned off, the whole sharpening process is completed, and the pencil sharpener returns to the initial state.

To sharpen pencils 9 of different diameters, the distance between the two symmetrically distributed rubber wheels 25 tightly pressing the surface of the pencil may be automatically adjusted with the diameter of the pencil 9, thus always ensuring that the rubber wheels 25 apply sufficient pressures and frictional forces to the pencil to perform the whole sharpening.

In the present application, the MCU, the first driving circuit and the second driving circuit are integrated on a printed circuit board (PCB) 8, and the PCB board 8 is located below the first switch 100 and is located within the sharpener body, as shown in FIGS. 1, 5 and 6. With such an arrangement, the internal space of the sharpener body can be effectively used, and the PCB board 8 is located at the lowermost of the sharpener body, and the bottom of the sharpener body may further be provided with an opening to facilitate the maintenance and installation of the PCB board 8.

It is to be noted that, in the present specification, relational terms such as "first" and "second" are merely used to distinguish an entity from several other entities without necessarily requiring or implying that any such actual relationship or order exists among these entities.

The electric pencil sharpener according to the present application is described in detail. The principle and the embodiments of the present application are illustrated herein by specific examples. The above description of examples is only intended to help the understanding of the method and concept of the present application. It should be noted that, for those skilled in the art, a few of improvements and modifications may be made to the present application without departing from the principle of the present application, and these modifications and improvements are also deemed to fall into the scope of protection of the present application defined by the claims.

The invention claimed is:

1. An electric pencil sharpener, comprising:

a power device connected to two rotatable rubber wheels via a transmission mechanism;

the two rubber wheels, which are located on two sides of a pencil to be sharpened, have opposite rotational directions and closely fit a side wall of the pencil to be sharpened to push the pencil upwards or downwards to be sharpened, a gap between the two rubber wheels being adjustable; and a rotatable cutter carrier assembly which is located below the rubber wheels and configured to sharpen the pencil to be sharpened, wherein the transmission mechanism comprises:

a cutter carrier gear connected to the power device and located below the rubber wheels, a rotation axis of the cutter carrier gear being perpendicular to a rotation axis of each of the rubber wheels;

an end face gear engaged with the cutter carrier gear, a rotation axis of the end face gear being in parallel with the rotation axis of each of the rubber wheels;

a transition gear located at an outer side of the end face gear and engaged with the end face gear, a rotation axis of the transition gear being in parallel with the rotation axis of the end face gear and located below the rotation axis of the end face gear; and a pencil introducing gear located at an upper side of the transition gear and engaged with the transition gear, wherein a pencil introducing gear shaft of the pencil introducing gear is moved coaxially with a rubber wheel shaft sleeve of the rubber wheels, and two pencil introducing gear shafts are both arranged onto a pencil introducing mechanism holder having a fixed relative position, two sides of the pencil introducing mechanism holder have arc-shaped retaining grooves configured to restrict movement loci of the respective pencil introducing gear shafts, the arcs of the two arc-shaped retaining grooves are coincident with movement loci of two pencil introducing gears with respect to the transition gear respectively to adjust the gap between the two rubber wheels, the electric pencil sharpener further comprises a multi-point control unit (MCU), a first switch, a second switch, a first driving circuit and a second driving circuit, wherein the first switch is arranged below the pencil to be sharpened, a tip touch block is provided between the first switch and a tip of the pencil to be sharpened, and when the pencil to be sharpened is delivered to the cutter carrier assembly by the rubber wheels and is sharpened by the cutter carrier assembly, the tip touches the tip touch block, and the first switch is turned on by a transmission rod;

the second switch is located at an entrance position of the pencil to be sharpened, and when the pencil to be sharpened is inserted between the two rubber wheels, a pencil introducing switch pressing block located at a movement locus of the pencil to be sharpened is pressed to an outer side of the pencil to be sharpened, to turn on the second switch;

the first switch and the second switch are respectively connected to two input pins of the MCU;

a first terminal of the first driving circuit and a first terminal of the second driving circuit are connected to two output pins of the MCU respectively, and a second terminal of the first driving circuit is connected to a first end of the power device, a second terminal of the second driving circuit is connected to a second end of the power device, the second terminal of the first driving circuit is connected to the second terminal of the second driving circuit;

a first ground electrode and a first voltage electrode are also connected between the first terminal of the first driving circuit and the second terminal of the first driving circuit, and a second ground electrode and a second voltage electrode are also connected between the first terminal of the second driving circuit and the second terminal of the second driving circuit; and when the first switch and the second switch are both turned off, the power device does not work, when the first switch is turned off and the second switch is turned on, the power device rotates toward a direction of transferring the pencil to be sharpened to the cutter carrier assembly, and when the first switch and the second switch are both turned on, the power device rotates toward a direction of moving the pencil to be sharpened away from the cutter carrier assembly.

2. The electric pencil sharpener according to claim 1, wherein the pencil introducing mechanism holder is provided with two racks connected to the pencil introducing gear shafts respectively, the two racks are each engaged with a return gear hinged to the pencil introducing mechanism holder, and the two racks are located at an upper side and a lower side of the return gear respectively to allow the two rubber wheels to synchronously clamp or release the pencil to be sharpened.

3. The electric pencil sharpener according to claim 2, wherein each of the two racks is also connected to a rack restoring spring, to allow the gap between the two rubber wheels to be restored to an initial state when the pencil to be sharpened is withdrawn from the gap between the two rubber wheels, and also to provide a clamping force of the two rubber wheels with respect to the pencil.

4. The electric pencil sharpener according to claim 3, wherein the cutter carrier assembly has a preset angle with respect to the pencil to be sharpened, and the cutter carrier assembly is connected to the power device to achieve rotary sharpening by the cutter carrier assembly.

5. The electric pencil sharpener according to claim 4, further comprising an internal gear configured to support the cutter carrier assembly and drive the cutter carrier assembly to rotate, wherein the internal gear is located at an outer side of the cutter carrier assembly and is connected to the power device.

6. The electric pencil sharpener according to claim 1, wherein the first driving circuit comprises a first NPN triode, a first PMOS transistor and a first NMOS transistor;

a base of the first NPN triode is connected to the MCU, an emitter of the first NPN triode is connected to the first ground electrode, and a collector of the first NPN triode is connected to the first voltage electrode;

a gate electrode of the first PMOS transistor and a gate electrode of the first NMOS transistor are each connected between the collector of the first NPN triode and the first voltage electrode;

a source electrode of the first PMOS transistor and a drain electrode of the first NMOS transistor are each connected to the first end of the power device;

and wherein the second driving circuit comprises a second NPN triode, a second PMOS transistor, and a second NMOS transistor;

a base of the second NPN triode is connected to the MCU, an emitter of the second NPN triode is connected to the second ground electrode, and a collector of the second NPN triode is connected to the second voltage electrode;

a gate electrode of the second PMOS transistor and a gate electrode of the second NMOS transistor are each connected between the collector of the second NPN triode and the second voltage electrode;

a source electrode of the second PMOS transistor and a drain electrode of the second NMOS transistor are each connected to the second end of the power device; and the source electrode of the first PMOS transistor is connected to the source electrode of the second PMOS transistor and is grounded; the source electrode of the first PMOS transistor is connected to the source electrode of the second PMOS transistor, and the drain electrode of the first PMOS transistor is connected to the drain electrode of the second PMOS transistor and is connected to the first ground electrode.

7. The electric pencil sharpener according to claim 6, wherein the first switch and the second switch are connected in parallel, and then are connected to a grounding output pin of the MCU and are then grounded.

8. The electric pencil sharpener according to claim 7, wherein the MCU, the first driving circuit and the second driving circuit are integrated on a printed circuit board, and the printed circuit board is located below the first switch.

* * * * *